United States Patent [19]

Pliefke et al.

[11] Patent Number: 4,824,535

[45] Date of Patent: Apr. 25, 1989

[54] PROCESS FOR THE ELECTROCHEMICAL GRAINING OF ALUMINUM FOR USE IN PRINTING PLATE SUPPORTS

[75] Inventors: Engelbert Pliefke, Wiesbaden; Dieter Mohr, Schlangenbad, both of Fed. Rep. of Germany

[73] Assignee: Hoechst Aktiengesellschaft, Frankfurt am Main, Fed. Rep. of Germany

[21] Appl. No.: 106,588

[22] Filed: Oct. 13, 1987

[30] Foreign Application Priority Data

Oct. 17, 1986 [DE] Fed. Rep. of Germany ..... 3635304

[51] Int. Cl.[4] ..... C25F 3/02

[52] U.S. Cl. ..... 204/129.75

[58] Field of Search ..... 204/129.75, 129.8

[56] References Cited

U.S. PATENT DOCUMENTS

| | | | |
|---|---|---|---|
| 2,344,510 | 3/1944 | Hagelin | 101/149.2 |
| 3,193,485 | 7/1965 | Vincent | 204/141 |
| 3,632,486 | 1/1972 | Herrmann et al. | 204/33 |
| 3,766,043 | 10/1973 | Herrmann et al. | 204/207 |
| 3,887,447 | 6/1975 | Sheasby et al. | 204/129.4 |
| 3,929,591 | 12/1975 | Chu et al. | 204/17 |
| 3,963,594 | 6/1976 | Brasko | 204/129.95 |
| 3,980,539 | 9/1976 | Lloyd et al. | 204/129.75 |
| 4,052,275 | 10/1977 | Gumbinner et al. | 204/129.95 |
| 4,072,589 | 2/1978 | Golda et al. | 204/129.4 |
| 4,087,341 | 5/1978 | Takahashi et al. | 204/129.43 |
| 4,172,772 | 10/1979 | Ould et al. | 204/129.85 |
| 4,272,342 | 6/1981 | Oda et al. | 204/129.4 |
| 4,294,672 | 10/1981 | Ohba et al. | 204/129.4 |
| 4,301,229 | 11/1981 | Sakaki et al. | 430/158 |
| 4,477,317 | 10/1984 | Chu et al. | 204/33 |

FOREIGN PATENT DOCUMENTS

| | | |
|---|---|---|
| 0036672 | 11/1983 | European Pat. Off. . |
| 0131926 | 1/1985 | European Pat. Off. . |
| 120061 | 2/1900 | Fed. Rep. of Germany . |
| 3036174 | 10/1983 | Fed. Rep. of Germany . |
| 53-91334 | 7/1978 | Japan . |
| 53-123204 | 10/1978 | Japan . |
| 53-145701 | 12/1978 | Japan . |
| 57-16918 | 4/1982 | Japan . |
| 58-197090 | 11/1983 | Japan . |
| 879768 | 10/1961 | United Kingdom . |
| 1400918 | 7/1975 | United Kingdom . |
| 2047274 | 11/1980 | United Kingdom . |
| 1582620 | 1/1981 | United Kingdom . |
| 2058136 | 4/1981 | United Kingdom . |
| 2060923 | 5/1981 | United Kingdom . |

OTHER PUBLICATIONS

"The Alternating Current Etching of Aluminum Lithographic Sheet"; A. J. Dowell in Transactions of the Institute of Metal Finishing, 1979; vol. 57, pp. 138–144.

*Primary Examiner*—T. M. Tufariello

*Attorney, Agent, or Firm*—Foley & Lardner, Schwartz, Jeffery, Schwaab, Mack, Blumenthal & Evans

[57] ABSTRACT

A process in disclosed for the multiple graining of aluminum or aluminum alloys for use in printing plate supports. In the process, mechanical graining is followed by graining with a direct current in a nitrate-containing electrolyte. Optionally, the graining is followed by an anodizing treatment.

18 Claims, No Drawings

PROCESS FOR THE ELECTROCHEMICAL GRAINING OF ALUMINUM FOR USE IN PRINTING PLATE SUPPORTS

BACKGROUND OF THE INVENTION

The present invention relates to a process for the electrochemical graining of aluminum for use in printing plate supports, the process being performed by means of a direct current in an electrolyte containing nitrate ions.

Printing plates (this term referring to offsetprinting plates, within the scope of the present invention) usually comprise a support and at least one radiation-sensitive (photosensitive) reproduction layer arranged thereon, the layer being applied to the support either by the user (in the case of plates which are not precoated) or by the industrial manufacturer (in the case of precoated plates).

As a layer support material, aluminum or alloys thereof have gained general acceptance in the field of printing plates. In principle, it is possible to use these supports without modifying pretreatment, but they are generally modified in or on their surfaces, for example, by a mechanical, chemical and/or electrochemical roughening process (also called graining or etching in the literature), a chemical or electrochemical oxidation process and/or a treatment with hydrophilizing agents. In modern continuously working high-speed equipment employed by the manufacturers of printing plate supports and/or precoated printing plates, a combination of the aforementioned modifying methods is frequently used, particularly a combination of electrochemical graining and anodic oxidation, optionally followed by a hydrophilizing step.

Graining is, for example, carried out in aqueous acids, such as aqueous solutions of HCl or $HNO_3$ or in aqueous salt solutions, such as aqueous solutions of NaCl or $Al(NO_3)_3$, using an alternating current. The peak-to-valley heights (specified, for example, as mean peak-to-valley heights $R_z$) of the roughened surface thus obtained are in the range from about 1 to 15 μm, particularly in the range from 2 to 8 μm. The peak-to-valley height is determined according to DIN 4768 (in the October 1970 version). The peak-to-valley height $R_z$ is then the arithmetic mean calculated from the individual peak-to-valley height values of five mutually adjacent individual measurement lengths.

Graining is, inter alia, carried out in order to improve the adhesion of the reproduction layer to the support and to improve the water/ink balance of the printing form which results from the printing plate upon irradiation (exposure) and development. By irradiating and developing (or decoating, in the case of electrophotographically working reproduction layers), the ink-receptive image areas and the water-retaining non-image areas (generally the bared support surface) in the subsequent printing operation, are produced on the printing plate, and thus the actual printing form is obtained. The final topography of the aluminum surface to be grained is influenced by various parameters. By way of example, the following passages from the literature supply information about these parameters:

The paper "The Alternating Current Etching of Aluminum Lithographic Sheet", by A. J. Dowell, published in Transactions of the Institute of Metal Finishing, 1979, Vol. 57, pages 138 to 144, presents basic comments on the roughening of aluminum in aqueous solutions of hydrochloric acid, based on variations of process parameters and an investigation of the corresponding effects. The electrolyte composition is changed during repeated use of the electrolyte, for example, in view of the $H^+(H_3O^+)$ ion concentration (measurable by means of the pH) and in view of the $Al^{3+}$ ion concentration, with influences on the surface topography being observed. Temperature is varied between 16° C. and 90° C., but does not show an influence causing changes until temperatures are about 50° C. or higher, the influence becoming apparent, for example, as a significant decrease in layer formation on the surface. Graining time is varied between 2 and 25 minutes and leads to an increasing metal dissolution with increasing duration of action. Current density is varied between 2 and 8 $A/dm^2$ and results in higher roughness values with rising current density. If the acid concentration is in a range from 0.17% to 3.3% of HCl, only negligible changes in pit structure occur between 0.5% and 2% of HCl, whereas below 0.5% of HCl, the surface is only locally attacked, and at the high values, an irregular dissolution of aluminum takes place.

The use of hydrochloric acid or nitric acid as an electrolyte in the graining of aluminum substrates is thus to be considered as being basically known in the art. A uniform graining can be obtained which is appropriate for lithographic plates and is within a useful roughness range. In pure nitric acid electrolytes, adjustment of an even and uniform surface topography is difficult and it is necessary to keep the operating conditions within very close limits.

Other references set forth the influence of the electrolyte composition on the quality of graining. For example, German Offenlegungsschrift No. 22 50 275 (equivalent to British Patent Specification No. 1,400,918) specifies aqueous solutions containing from 1.0% to 1.5% by weight of $HNO_3$ or from 0.4% to 0.6% by weight of HCl and optionally from 0.4% to 0.6% by weight of $H_3PO_4$, for use as electrolytes in the graining of aluminum for printing plate supports, by means of an alternating current. German Offenlegungsschrift No. 28 10 308 (equivalent to U.S. Pat. No. 4,072,589) mentions aqueous solutions containing from 0.2% to 1.0% by weight of HCl and from 0.8% to 6.0% by weight of $HNO_3$ as electrolytes in the graining of aluminum with an alternating current.

Additives may be used in the HCl electrolyte to prevent an adverse local attack in the form of deep pits. For example, German Offenlegungsschrift No. 28 16 307 (equivalent to U.S. Pat. No. 4,172,772) discloses monocarboxylic acids, such as acetic acid, U.S. Pat. No. 3,963,594 shows gluconic acid, European Patent Application No. 0 036 672 suggests citric acid and malonic acid and U.S. Pat. No. 4,052,275 discloses tartaric acid. All these organic electrolyte components have the disadvantage of being electrochemically unstable and decomposing in the case of a high current load (voltage).

Inhibiting additives, for example, phosphoric acid and chromic acid as described in U.S. Pat. No. 3,887,447 or boric acid as described in German Offenlegungsschrift No. 25 35 142 (equivalent to U.S. Pat. No. 3,980,539) have the disadvantage that there is often a local breakdown of the protective effect and individual, particularly pronounced pits can form in these places.

Japanese Patent Application No. 91 334/78 describes graining by means of an alternating current in a composition comprising hydrochloric acid and an alkalimetal halide to produce a lithographic support material.

German Offenlegungsschrift No. 16 21 115 (equivalent to U.S. Pat. Nos. 3,632,486 and 3,766,043) describes graining by means of a direct current, using dilute hydrofluoric acid, with the web being made the cathode.

German Patent No. 120 061 describes a treatment for generating a hydrophilic layer by the application of electric current, which treatment can also be performed in hydrofluoric acid.

Another known possibility for improving the uniformity of electrochemical graining comprises a modification of the type of electric current employed. For example, an alternating current can be used in which the anodic voltage and the anodic coulombic input are higher than the cathodic voltage and the cathodic coulombic input, the anodic half-cycle period of the alternating current being generally adjusted to be less than the cathodic half-cycle period. This method is referred to in German Offenlegungsschrift No. 26 50 762 (equivalent to U.S. Pat. No. 4,087,341), German Offenlegungsschrift No. 29 12 060 (equivalent to U.S. Pat. No. 4,301,229), German Offenlegungsschrift No. 30 12 135 (equivalent to British Patent Application No. 2,047,274) or German Offenlegungsschrift No. 30 30 815 (equivalent to U.S. Pat. No. 4,272,342).

Another method is to use an alternating current in which the anodic voltage is markedly increased compared with the cathodic voltage, according to German Offenlegungsschrift No. 14 46 026 (equivalent to U.S. Pat. No. 3,193,485).

Another method is to interrupt the current flow for 10 to 120 seconds and re-apply current for 30 to 300 seconds, using an alternating current and, as the electrolyte, an aqueous solution of 0.75 to 2.0 N HCl, with the addition of NaCl or $MgCl_2$, according to British Patent No. 879,768. A similar process comprising an interruption of current flow in the anodic or cathodic phase is also disclosed in German Offenlegungsschrift No. 30 20 420 (equivalent to U.S. Pat. No. 4,294,672).

The aforementioned methods may lead to relatively uniformly grained aluminum surfaces, but they sometimes require a comparatively great equipment expenditure and, in addition, are applicable only within very closely limited parameters.

Another procedure is a combination of two graining processes. For example, U.S. Pat. No. 3,929,591; British Patent No. 1,582,620; Japanese Patent Application No. 123 204/78; German Offenlegungsschrift No. 30 31 764 (equivalent to British Patent Application No. 2,058,136); German Offenlegungsschrift No. 30 36 174 (equivalent to British Patent Application No. 2,060,923); European Patent Application No. 0,131,926; German Offenlegungsschrift No. 30 12 135 (equivalent to British Patent Application No. 2,047,274) and Japanese Patent Application No. 16 918/82 describe various forms of a combination comprising a pre-texturing treatment which is carried out mechanically in a first step and is optionally followed by chemical cleaning (pickling) and an ensuing electrochemical graining process, in which an optionally modified alternating current is applied in an electrolyte containing hydrochloric acid or nitric acid and which may be followed by an additional cleaning step. All of these references use the advantage of double-graining, which lies, in particular, in a saving of current, but they use an alternating current in the second step.

U.S. Pat. No. 2,344,510 describes the use of graining by means of a direct current in an electrolyte containing hydrochloric acid, which is carried out as a second graining step following a mechanical pre-graining treatment.

SUMMARY OF THE INVENTION

It is therefore an object of the present invention to provide a process for the electrochemical graining of aluminum for use in printing plate supports by means of a direct current, which process results in a uniform, pit-free and overall graining structure and which can be performed without great equipment expenditure and/or particularly closely limited parameters and which also saves energy. The printing plates so produced should yield long print runs and have a low consumption of dampening solution.

The invention is a process for the combined graining of aluminum, in which mechanical graining is first performed, followed by electrolytic graining in a nitrate-containing electrolyte.

Unexpectedly, by the application of a direct current in a nitrate-containing electrolyte, following a mechanical pre-graining treatment with an optional post-cleaning step, a surface results which is excellently suited for lithographic applications, which leads to the saving of energy and, due to the specific shape and arrangement of the micropores, additionally has the advantages of a reduced consumption of dampening solution and an increased print-run stability. These advantages cannot be achieved either by the use of an alternating current in systems containing hydrochloric acid or nitric acid or by the application of a direct current in hydrochloric acid, as described in U.S. Pat. No. 2,344,510 (see Comparison Examples Cl to C5).

An alternating current in nitric acid electrolytes leads to surfaces that are substantially free from any coating, whereas in the process according to the invention, which uses a direct current in the weakly corrosive electrolyte containing nitrate ions, a protective whitish coating which can favorably influence the graining process is formed in the pores during the electrochemical step. The action of the more strongly corrosive chloride ions in the application of a direct current obviously leads to different support structures which are less suitable for modern lithographic printing plates.

DESCRIPTION OF THE PREFERRED EMBODIMENTS

In the invention, the electrolytic graining treatment is effected by means of a direct current.

Mechanical graining is preferably carried out using a moist abrasive (slurry brushing), however, it is also possible to employ other mechanical pre-texturing methods, for example, dry brushing, sandblasting, ball graining, embossing or similar processes.

Following the graining steps the sheet is preferably cleaned in an etching step comprising a removal of metal. This etching step (pickling) can either be performed with the aid of acids or bases or with aggressive agents which are electrochemically generated in the bath, for example, by the cathodic generation of hydroxyl ions.

In a preferred embodiment a nitrate electrolyte is used, in which the concentration of the nitrate compound ranges between about 1.0 g/l and the saturation limit, preferably between about 5.0 g/l and 100.0 g/l. The preferred compounds containing nitrate ions comprise aluminum nitrate and/or nitric acid and/or sodium nitrate. Within the scope of the present invention it is naturally also possible to use combinations of other compounds containing nitrate ions. It has proved to be particularly advantageous to admix the electrolyte with aluminum salts, preferably in an amount from about 20 to 150 g/l.

The direct current used for the sheet which is preferably made the anode has a current density in the range from about 1 to 300 A/dm$^2$, preferably from about 10 to 100 A/dm$^2$, such that a quantity of charge ranging from about 1 to 400 C/dm$^2$, preferably from about 10 to 200 C/dm$^2$, passes. In the process, the current density used is less critical than the total quantity of charge.

A surface produced according to the process of the present invention results in a very uniform support surface, which can be varied within a wide range of peak-to-valley heights ($R_z$=2 to 7 μm) and has excellent lithographic properties.

The process of the invention is carried out either discontinuously or preferably continuously, using webs of aluminum or aluminum alloys. In continuous processes, the process parameters during electrochemical graining are generally within the following ranges: temperature of the electrolyte between about 20° and 80° C., current density between about 1 and 300 A/dm$^2$, dwell time of a material spot to be grained in the electrolyte between about 1 and 300 seconds, preferably between about 2 and 60 seconds, and rate of flow of the electrolyte on the surface of the material to be grained between about 5 and 1000 cm/second. In discontinuous processes, the required current densities are rather in the lower region and the dwell times rather in the upper region of the ranges indicated in each case; a flow of the electrolyte can even be dispensed with in these processes.

In addition to pure direct current it is also possible to use direct currents that are pulsed or undulated or have other shapes, as long as there is no change in the polarity of the sheet during the entire graining process.

The following materials which are in the form of a sheet, a foil or a web may, for example, be used for graining in the process of the invention:

"Pure aluminum" (DIN Material No. 3.0255), i.e., composed of more than 99.5% Al, and the following permissible admixtures (maximum total 0.5%) of 0.3% Si, 0.4% Fe, 0.03% Ti, 0.02% Cu, 0.07% Zn and 0.03% of other substances, or "Al-alloy 3003" (comparable to DIN Material No. 3.0515), i.e., composed of more than 98.5% Al, 0 to 0.3% Mg and 0.8% to 1.5% Mn, as alloying constituents, and 0.5% Si, 0.5% Fe, 0.2% Ti, 0.2% Zn, 0.1% Cu and 0.15% of other substances, as permissible admixtures.

The process of the present invention can, however, also be used with other aluminum alloys.

The electrochemical graining step which characterizes the present invention may be followed —after a possible further cleaning step comprising a removal of metal, as described above —by an anodic oxidation of the aluminum in a further process step, in order to improve, for example, the abrasive and adhesive properties of the surface of the support material. Conventional electrolytes, such as $H_2SO_4$, $H_3PO_4$, $H_2C_2O_4$, amidosulfonic acid, sulfosuccinic acid, sulfosalicylic acid or mixtures thereof, may be used for the anodic oxidation. The following are standard methods for the use of aqueous $H_2SO_4$-containing electrolytes for the anodic oxidation of aluminum (see, in this regard, e.g., M. Schenk, Werkstoff Aluminium und seine anodische Oxydation [The Material Aluminum and its Anodic Oxidation], Francke Verlag, Bern, 1948, page 760; Praktische Galvanotechnik [Practical Electroplating], Eugen G. Leuze Verlag, Saulgau, 1970, pages 395 et seq., and pages 518/519; W. Huebner and C. T. Speiser, Die Praxis der anodischen Oxidation des Aluminiums [Practical Technology of the Anodic Oxidation of Aluminum], Aluminium Verlag, Duesseldorf, 1977, 3rd Edition, pages 137 et seq.):

The direct current sulfuric acid process, in which anodic oxidation is carried out in an aqueous electrolyte which conventionally contains approximately 230 g of $H_2SO_4$ per 1 liter of solution, for 10 to 60 minutes at 10° C. to 22° C., and at a current density of 0.5 to 2.5 A/dm$^2$. In this process, the sulfuric acid concentration in the aqueous electrolyte solution can also be reduced to 8% to 10% by weight of $H_2SO_4$ (about 100 g of $H_2SO_4$ per liter), or it can also be increased to 30% by weight (365 g of $H_2SO_4$ per liter), or more.

The "hard-anodizing process" is carried out using an aqueous electrolyte, containing $H_2SO_4$ in a concentration of 166 g of $H_2SO_4$ per liter (or about 230 g of $H_2SO_4$ per liter), at an operating temperature of 0° to 5° C, and at a current density of 2 to 3 A/dm$^2$, for 30 to 200 minutes, at a voltage which rises from approximately 25 to 30 V at the beginning of the treatment, to approximately 40 to 100 V toward the end of the treatment.

In addition to the processes for the anodic oxidation of printing plate support materials which have already been mentioned in the preceding paragraph, the anodic oxidation of aluminum can be carried out, for example, in an aqueous, $H_2SO_4$-containing electrolyte, in which the content of $Al^{3+}$ ions is adjusted to values exceeding 12 g/l (according to German Offenlegungsschrift No. 28 11 396, equivalent to U.S. Pat. No. 4,211,619), in an aqueous electrolyte containing $H_2SO_4$ and $H_3PO_4$ (according to German Offenlegungsschrift No. 27 07 810, equivalent to U.S. Pat. No. 4,049,504), or in an aqueous electrolyte containing $H_2SO_4$, $H_3PO_4$ and $Al^{3+}$ ions (according to German Offenlegungsschrift No. 28 36 803, equivalent to U.S. Pat. No. 4,229,226). U.S. Pat. Nos. 4,211,619, 4,049,504 and 4,229,226 are incorporated herein by reference.

Direct current is preferably used for the anodic oxidation, but it is also possible to use alternating current or a combination of these types of current (for example, direct current with superimposed alternating current).

The layer weights of aluminum oxide range from about 1 to 10 g/m$^2$, which correspond to layer thicknesses from about 0.3 to 3.0 μm. After the electrochemical graining step and prior to an anodic oxidation step, an etching modification of the grained surface may additionally be performed, as described, for example, in German Offenlegungsschrift No. 30 09 103, incorporated herein by reference. A modifying intermediate treatment of this kind can, inter alia, enable the formation of abrasion-resistant oxide layers and reduce the tendency to scumming in the subsequent printing operation.

The nodic oxidation step of the aluminum support material for printing plates is optionally followed by one or more post-treatment steps. Post-treatment is particularly understood to be a hydrophilizing chemical or electrochemical treatment of the aluminum oxide layer, for example, an immersion treatment of the material in an aqueous solution of polyvinyl phosphonic acid according to German Patent No. 16 21 478 (equivalent to British Patent No. 1,230,447), an immersion treatment in an aqueous solution of an alkali metal silicate according to German Auslegeschrift No. 14 71 707 (equivalent to U.S. Pat. No. 3,181,461), or an electrochemical treatment (anodization) in an aqueous solution of an alkali-metal silicate according to German Offenlegungsschrift No. 25 32 769 (equivalent to U.S. Pat. No. 3,902,976). These post-treatment steps serve, in particular, to even further improve the hydrophilic properties of the aluminum oxide layer, which are already sufficient for many fields of application, while maintaining the other well-known properties of the layer. British Patent No. 1,230,447, U.S. Pat. Nos. 3,181,461 and 3,902,976 are incorporated herein by reference.

Suitable photosensitive reproduction layers basically comprise any layers which, after exposure and optional development and/or fixing, yield a surface in image configuration, which can be used for printing and/or which represents a relief image of an original. The layers are applied to one of the customary support materials, either by the manufacturer of presensitized printing plates or so-called dry resists or directly by the user.

The photosensitive reproduction layers include those which are described, for example, in "Light-Sensitive Systems", by Jaromir Kosar, published by John Wiley & Sons, New York, 1965: layers containing unsaturated compounds, which, upon exposure, are isomerized, rearranged, cyclized, or crosslinked (Kosar, Chapter 4); layers containing compounds, e.g., monomers or prepolymers, which can be photopolymerized, which, on being exposed, undergo polymerization, optionally with the aid of an initiator (Kosar, Chapter 5); and layers containing o-diazoquinones, such as naphthoquinonediazides, p-diazoquinones, or condensation products of diazonium salts (Kosar, Chapter 7).

Other suitable layers include the electrophotographic layers, i.e., layers which contain an inorganic or organic photoconductor. In addition to the photosensitive substances, these layers can, of course, also contain other constituents, such as, for example, resins, dyes, pigments, wetting agents, sensitizers, adhesion promoters, indicators, plasticizers or other conventional auxiliary agents. In particular, the following photosensitive compositions or compounds can be employed in the coating of the support materials and their references are incorporated herein by reference:

(1) positive-working o-quinone diazide com- pounds, preferably o-naphthoquinone diazide compounds, which are described, for example, in German Patent Nos. 854 890, 865 109, 879 203, 894 959, 938 233, 11 09 521, 11 44 705, 11 18 606, 11 20 273 and 11 24 817;

(2) negative-working condensation products from aromatic diazonium salts and compounds with active carbonyl groups, preferably condensation products formed from diphenylaminediazonium salts and formaldehyde, which are described, for example, in German Patent Nos. 596 731, 11 38 399, 11 38 400, 11 38 401, 11 42 871, and 11 54 123, U.S. Pat. Nos.2,679,498 and 3,050,502 and British Patent No. 712 606;

(3) negative-working co-condensation products of aromatic diazonium compounds, for example according to German Offenlegungsschrift No. 20 24 244, which possess, in each case, at least one unit of the general types $A(-D)_n$ and B, connected by a divalent linking member derived from a carbonyl compound which is capable of participating in a condensation reaction. In this context, these symbols are defined as follows: A is the radical of a compound which contains at least two aromatic carbocyclic and/or heterocyclic nuclei, and which is capable, in an acid medium, of participating in a condensation reaction with an active carbonyl compound, at one or more positions. D is a diazonium salt group which is bonded to an aromatic carbon atom of A; n is an integer from 1 to 10, and B is the radical of a compound which contains no diazonium groups and which is capable, in an acid medium, of participating in a condensation reaction with an active carbonyl compound, at one or more positions on the molecule;

(4) positive-working layers according to German Offenlegungsschrift No. 26 10 842, which contain a compound which, on being irradiated, splits off an acid, a compound which possesses at least one C-O-C group, which can be split off by acid (e.g., an orthocarboxylic acid ester group, or a carboxamide-acetal group), and, if appropriate, a binder;

(5) negative-working layers, composed of photopolymerizable monomers, photo-initiators, binders and, if appropriate, further additives. In these layers, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschriften No. 20 64 079 and No. 23 61 041. Suitable photo-initiators are, inter alia, benzoin, benzoin ethers, polynuclear quinones, acridine derivatives, phenazine derivatives, quinoxaline derivatives, quinazoline derivatives, or synergistic mixtures of various ketones. A large number of soluble organic polymers can be employed as binders, for example, polyamides, polyesters, alkyd resins, polyvinyl alcohol, polyvinyl-pyrrolidone, polyethylene oxide, gelatin or cellulose ethers; and (6) negative-working layers according to German Offenlegungsschrift No. 30 36 077, which contain, as the photosensitive compound, a diazonium salt polycondensation product, or an organic azido compound, and which contain, as the binder, a high-molecular weight polymer with alkenylsulfonylurethane or cycloalkenylsulfonylurethane side groups.

It is also possible to apply photo-semiconducting layers to the support materials, such as described, for example, in German Pat. Nos. 11 17 391, 15 22 497, 15 72 312, 23 22 046 and 23 22 047, incorporated herein by reference, as a result of which highly photosensitive electrophotographic layers are produced. The materials for printing plate supports, which have been grained according to the process of the present invention, exhibit a very uniform topography, which positively influences the stability of print runs and the water/ink balance during printing with printing forms manufactured from these supports. Compared with the use of other processes "pits" (pronounced depressions, in comparison to the surrounding graining) occur less frequently and can even be completely suppressed; using the process of the present invention it is, in particular, possible to produce even, pit-free supports. In a direct comparison with Comparison Examples C1 to C5 (alternating current or HCl electrolyte, resp.) Examples 1 to 4 show the effect of the direct current in electrolytes containing nitrate ions, as a means of obtaining uniform surfaces, which yield considerable advantages in the printing process, with respect to a reduction of the consumption of dampening solution and an increase of the print run.

These surface properties can be realized without particularly great equipment expenditure.

EXAMPLE 1

An aluminum sheet is pre-textured with cutting abrasives in a slurry-graining process using rotating brushes, to give a peak-to-valley height $R_z$ of 4.3 μm and is then pickled for 30 seconds in a 3% strength sodium hydroxide solution. In the next step, the sheet is anodically grained for 10 seconds at 40° C. by means of a direct current of 20 A/dm$^2$ in an electrolyte containing 20 g/l of $HNO_3$ and 50 g/l of $Al(NO_3)_3 \cdot 9\ H_2O$ and then cleaned for 1 minute in a 2.5% strength NaOH bath at 60° C. After an anodizing treatment to produce an oxide layer of 3 g/m$^2$ and coating with a solution of:

6.6 parts by weight of a cresol/formaldehyde novolak (with softening range of 105° to 120° C., according to DIN 53 181),
1.1 parts by weight of 4-(2-phenyl-prop-2-yl)- phenyl-1,2-naphthoquinone-2- diazide-4-sulfonate,
0.6 part by weight of 2,2'-bis-1,2-naphtho- quinone-2-diazide-5- sulfonyloxy-1,1-dinaphthyl- methane,
0.24 part by weight of 1,2-naphthoquinone-2- diazide-4-sulfochloride,
0.08 part by weight of crystal violet,
91.36 parts by weight of a solvent mixture composed of: 4 parts by volume of ethylene glycol monomethyl ether, 5 parts by volume of tetrahydro- furan, and 1 part by volume of butyl acetate, a printing form thus obtained yields a print run of 175,000 copies and has a consumption of dampening solution of 23 scale units.

EXAMPLE 2

A plate is prepared and coated as described in Example 1. However, in the electrochemical step, the plate is anodically grained for 3 seconds at 60 A/dm$^2$ in the same electrolyte. With the same coating as used in Example 1, the plate prints 165,000 copies. The consumption of dampening solution amounts to 25 scale units.

EXAMPLE 3

A plate prepared and coated as described in Example 1, but which has been anodically grained for 5 seconds at 20 A/dm$^2$ in a 10% strength aluminum nitrate solution and cleaned for 60 seconds in a 2.5% strength NaOH solution at 60° C. prints 150,000 copies under identical conditions and has a consumption of dampening solution of 30 scale units.

EXAMPLE 4

A plate prepared and coated as described in Example 1, but which has been anodically grained for 5 seconds at 30 A/dm$^2$ in a 7% strength sodium nitrate solution, prints 155,000 copies under identical conditions and has a consumption of dampening solution of 32 scale units.

COMPARISON EXAMPLE C1

A plate prepared and coated as described in Example 1, but which has been anodically grained for 10 seconds by means of an alternating current of 20 A/dm$^2$ yields a print run of 110,000 copies and has a consumption of dampening solution of 45 scale units.

COMPARISON EXAMPLE C2

A plate prepared and coated as described in Example 1, but which has been anodically grained for 20 seconds by means of an alternating current of 20 A/dm$^2$ yields a print run of 120,000 copies and has a consumption of dampening solution of 40 scale units.

COMPARISON EXAMPLE C3

A plate prepared and coated as described in Example 1, but which has been anodically grained for 10 seconds by means of a direct current of 20 A/dm$^2$ in an electrolyte containing 20 g/l of HCl prints 110,000 copies and has a consumption of dampening solution of 42 scale units.

COMPARISON EXAMPLE C4

A plate prepared and coated as described in Example 1 and anodically grained for 10 seconds by means of a direct current of 20 A/dm$^2$, but using an electrolyte containing 10 g/l of HCl prints 115,000 copies and has a consumption of dampening solution of 41 scale units.

COMPARISON EXAMPLE C5

A plate prepared and coated as described in Comparison Example C4, but which has been anodically grained in an electrolyte containing 12 g/l of HCl and 50 g/l of $AlCl_3 \cdot 6\ H_2O$ produces a print run of 115,000 copies and has a consumption of dampening solution of 39 scale units.

In all examples printing was effected under identical conditions using the same printing machine ("Roland Favorit"). The amount of dampening solution applied is determined by an indicating device used in a dampening unit manufactured by Dahlgren. The measurements taken are comparative measurements: a reduced number of scale units indicates a lower consumption of dampening solution.

what is claimed is :

1. A process for the production of aluminum or aluminum alloy substrates for use in the manufacture of printing plates, comprising the steps of:

mechanically graining the substrate and then, electrochemically graining in a nitrate containing electrolyte having a concentration of nitrate compound ranging from about 1.0 g/l the saturation limit by means of a direct current of from about 1 to 300 A/dm$^2$ at a quantity of charge of from about 1 to 400 C/dm$^2$.

2. A process as claimed in claim 1, wherein the concentration of the nitrate compound ranges from about 5.0 g/l to 100 g/l.

3. A process as claimed in claim 1, wherein the nitrate-containing electrolyte comprises nitric acid.

4. A process as claimed in claim 1, wherein the nitrate-containing electrolyte comprises solutions of alkali metal nitrate, alkaline earth metal nitrate, ammonium nitrate, aluminum nitrate, nitric acid or mixtures thereof.

5. A process as claimed in claim 1, wherein the electrochemical graining step comprises a direct current of from about 10 to 100 A/dm$^2$ at a quantity of charge of from about 10 to 200 C/dm$^2$.

6. A process as claimed in claim 1, wherein the electrochemical graining step lasts for about 1 to 300 seconds.

7. A process as claimed in claim 6, wherein the electrochemical graining step lasts for about 2 to 60 seconds.

8. A process as claimed in claim 1, wherein a cleaning step is performed after at least one of the graining steps.

9. A process as claimed in claim 8, wherein the cleaning step comprises an alkaline cleaning treatment.

10. A process as claimed in claim 9, wherein the cleaning step is performed by means of an alkali metal hydroxide.

11. A process as claimed in claim 1, wherein the electrochemical graining step is followed by an anodizing treatment.

12. A process as claimed in claim 11, wherein the anodizing treatment produces an oxide layer weight of 5 $g/m^2$.

13. A process as claimed in claim 1, wherein the temperature used in the electrochemical graining step ranges from about 20° to 80° C.

14. A process as claimed in claim 1, wherein the mechanical graining step comprises slurry brushing.

15. A process as claimed in claim 1, wherein the electrochemical graining step is carried out in an agitated electrolyte at a rate of flow ranging between about 5 and 1000 cm/s.

16. An aluminum or aluminum alloy substrate produced according to the process of claim 1.

17. A printing plate produced according to the of claim 1.

18. A printing plate according to claim 17, further comprising a photosensitive layer.

* * * * *

UNITED STATES PATENT AND TRADEMARK OFFICE

CERTIFICATE OF CORRECTION

PATENT NO. : 4,824,535

DATED : April 25, 1989

INVENTOR(S) : Engelbert PLIEFKE et al.

It is certified that error appears in the above-identified patent and that said Letters Patent is hereby corrected as shown below:

Claim 17, line 1, after "the" insert --process--.

Signed and Sealed this

Twentieth Day of February, 1990

*Attest:*

JEFFREY M. SAMUELS

*Attesting Officer*

*Acting Commissioner of Patents and Trademarks*